US006761119B2

(12) United States Patent
Davis

(10) Patent No.: US 6,761,119 B2
(45) Date of Patent: Jul. 13, 2004

(54) STORAGE AND TABLE UNIT

(76) Inventor: Lynn Davis, Hwy. 32 West, Houlka, MS (US) 38850

( * ) Notice: Subject to any disclaimer, the term of this patent is extended or adjusted under 35 U.S.C. 154(b) by 0 days.

(21) Appl. No.: 10/072,087

(22) Filed: Feb. 8, 2002

(65) Prior Publication Data

US 2002/0078861 A1 Jun. 27, 2002

(51) Int. Cl.[7] ..... A47B 85/00
(52) U.S. Cl. ..... 108/14; 312/241
(58) Field of Search ..... 108/11, 13, 14, 108/17, 18, 90, 65, 69, 156, 38; 190/11, 12 A; 312/241, 265.5, 263, 329

(56) References Cited

U.S. PATENT DOCUMENTS

| | | | | | |
|---|---|---|---|---|---|
| 193,339 | A | * | 7/1877 | Lothrop | 108/14 |
| 1,903,026 | A | * | 3/1933 | Buckley | 312/241 |
| 2,473,022 | A | * | 6/1949 | Fenske, Jr. | 190/12 R |
| 3,880,485 | A | * | 4/1975 | Schmelzer | 312/282 |
| 4,034,518 | A | * | 7/1977 | Trecker | 5/114 |
| 4,213,209 | A | | 7/1980 | Insall et al. | |
| 4,577,475 | A | | 3/1986 | Herrera | |
| 4,779,940 | A | * | 10/1988 | Ralston | 312/241 |
| 4,848,626 | A | | 7/1989 | Waters | |
| 4,911,296 | A | | 3/1990 | Hart, Jr. | |
| 4,946,215 | A | * | 8/1990 | Taylor | 296/37.6 |
| 5,299,722 | A | | 4/1994 | Cheney | |
| 5,469,999 | A | | 11/1995 | Phirippidis | |
| 5,713,468 | A | * | 2/1998 | Streichan | 206/372 |
| 5,730,344 | A | | 3/1998 | Mauch | |
| 5,864,981 | A | | 2/1999 | Zeman | |
| 5,979,725 | A | | 11/1999 | Lehrman | |
| 5,997,112 | A | * | 12/1999 | Karten et al. | 312/140.2 |
| 6,209,346 | B1 | | 4/2001 | Frosch | |
| 6,386,386 | B1 | * | 5/2002 | George | 220/526 |

OTHER PUBLICATIONS

Sports Caddy, Skymall brochure, p. 62, Jun. 6, 2000.
Tailgator brochure, Flambeau Products Corporation, 1995.

* cited by examiner

*Primary Examiner*—Janet M. Wilkens
(74) *Attorney, Agent, or Firm*—Womble Carlyle Sandridge & Rice, PLLC

(57) ABSTRACT

A storage chest that converts into a table. The storage chest includes a cover that detaches from the storage unit and, when legs are added, converts to a table top. The cover/table top includes grooved slots for holding beverage containers. Table legs are stored within a storage compartment of the storage unit and attach to the table top to form the table. The storage and table unit further includes doors that detach from the storage unit and attach to the cover to form table top extensions. Thus, the storage and table unit conveniently stores and organizes items, and may also be used as a table for supporting food, beverages and other items.

13 Claims, 10 Drawing Sheets

STORAGE AND TABLE UNIT

BACKGROUND OF THE INVENTION

The present invention relates to a combination storage and table unit. Many present day events, such as tailgating events, camping events and picnics, require a variety of items to be stored, organized and transported. People attending tailgating events and picnics often transport food, beverages, clothes and other items to such events in their personal vehicles, such as sport utility vehicles (SUV's). Such vehicles do not normally have suitable means for storing, organizing and transporting food and drink items to these events. Furthermore events such as tailgating events and picnics often take place in locations that lack adequate means for storing and organizing items that are transported by people. Many coolers, cooking apertures, and the its like have been developed, but none appear to as easily convertible and convenient as the product of the present invention.

SUMMARY OF THE INVENTION

The present invention discloses a combination storage and table unit. The storage and table unit comprises multiple storage compartments for storing and organizing food, beverages and other items. In addition to storing various items, the storage and table unit converts from a storage container into a table and, in the preferred embodiment, a table that can be selectively extended.

The storage and table unit includes a detachable lid that detaches from a main body of the storage and table unit to form a table top. The lid/table top includes grooved slots for holding beverage containers. Table legs are stored within a storage compartment of the storage and table unit and attach to the table top to form a table. The storage and table unit further includes removable front doors that detach from the main body of the storage and table unit and attach to the lid/table top to form table top extensions.

The storage and table unit of the present invention is designed to fit within the rear of most present day sports utility vehicles (SUV's) and can also fit within other types of vehicles. The storage and table unit is constructed from washable plastic, and may be removed from a vehicle for packing, unpacking or cleaning. Because the storage and table unit stores various types of items and converts from a storage container into a table, it is particularly well-suited for use at picnics, camping trips, and tailgating events.

It is an object of the invention to provide a new storage and table unit that is portable, capable of storing a wide variety of items, and can be converted from a storage container to a table for supporting food, beverages and other items. It is a further object of the invention to provide a new storage and table unit that will fit in a SUV. Other objects and features of the invention will be readily apparent to those of skill in the art upon reading the following detailed description, when taken in conjunction with the accompanying drawings.

DETAILED DESCRIPTION OF THE INVENTION

Figure 1:
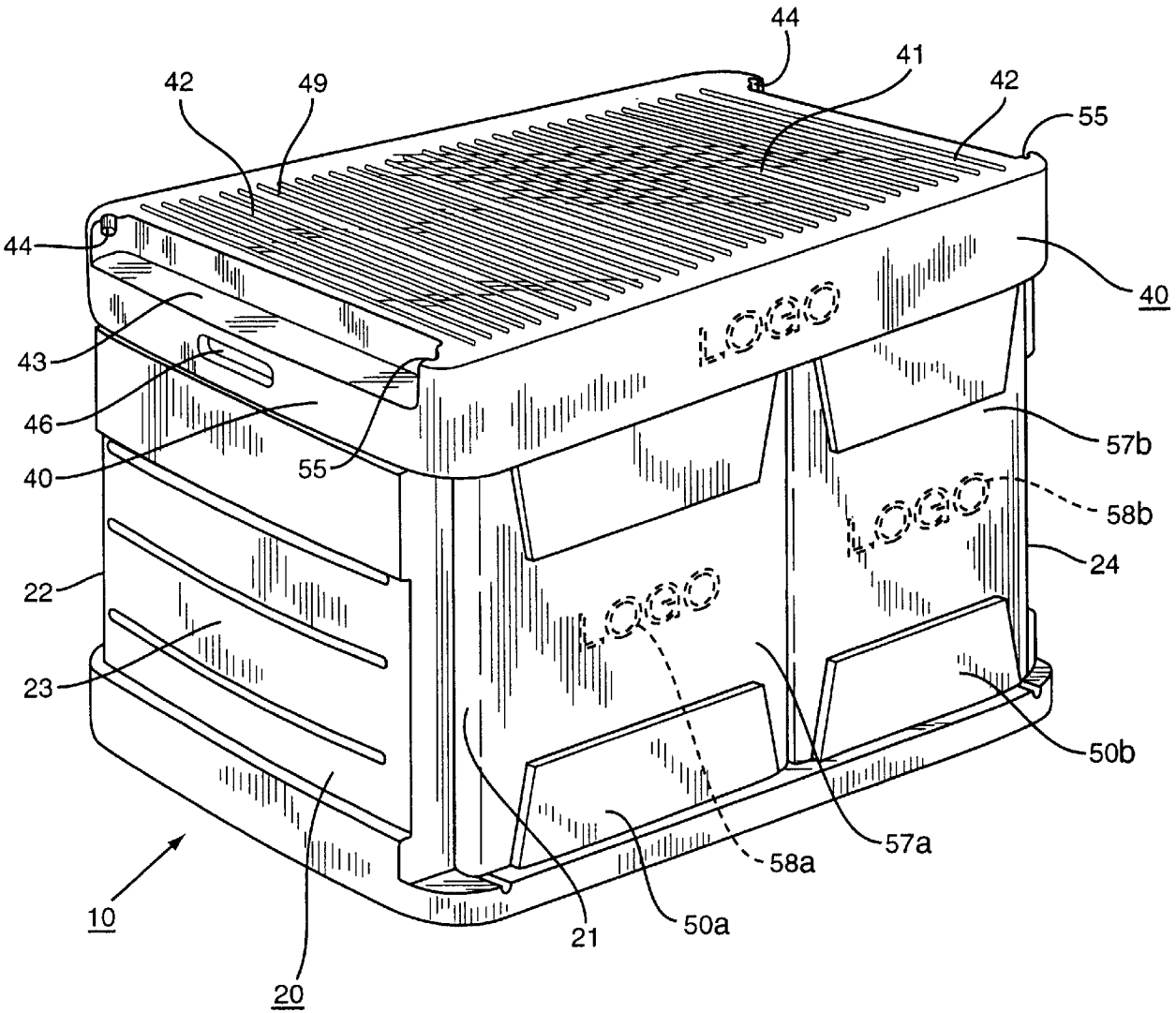
FIG. 1 shows a front perspective view of an SUV storage and table unit according to one embodiment of th invention.
Figure 2:
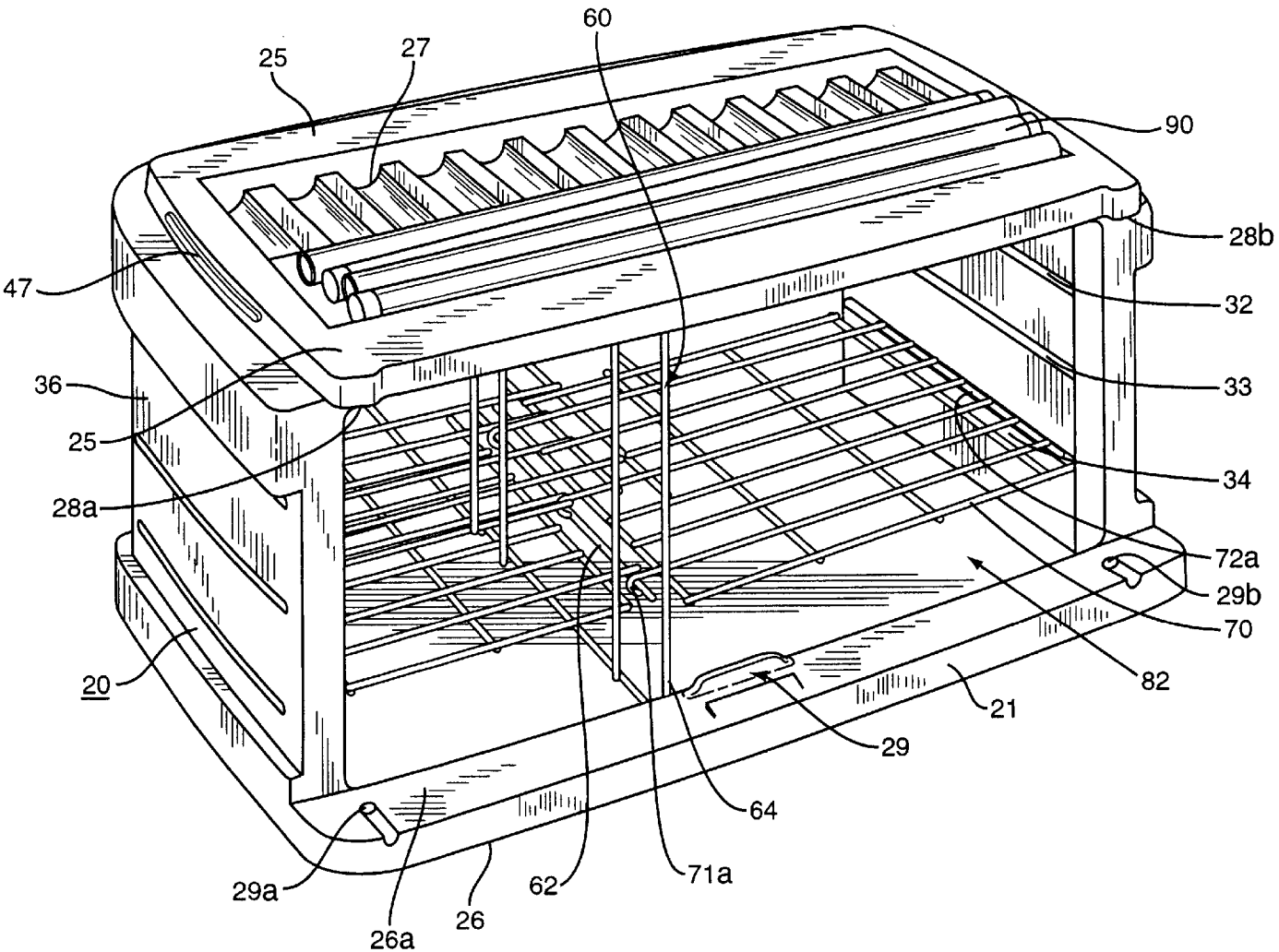
FIG. 2 shows a front perspective view of the SUV storage and table unit of FIG. 1 with the lid and doors detached.

With reference to drawing FIGS. 1 through 9, a new combination storage and table unit 10 will be described. As will be apparent from the following description, the combination storage and table unit converts from a storage container to a table. As best shown in FIGS. 1 and 2, the storage and table unit 10 comprises a main body 20, a removable lid 40 and a pair of removable doors 50*a*, 50*b*. The main body 20 includes a top wall 25, a bottom wall 26, front and back sides 21, 22 and first and second ends 23, 24. According to a preferred embodiment of the invention, each of the above components is molded of washable plastic, however, may be constructed of other suitable materials. The storage and table unit 10 is portable and is sized to fit within a sport utility vehicle (SUV) or other vehicle. One size that has been found to be satisfactory is length—39", width—24", and height—27". The storage and table unit 10 will now be described in greater detail.

The top wall 25 of main body 20 includes a plurality of beverage wells 27 which conveniently receive canned drinks. The front portion of the top wall 25 and bottom wall 26 contain pivot pin recesses 28*a*, 28*b* which releasably mount the front doors 50*a*, 50*b*. The lower front ledge 26*a* of bottom wall 26 includes a ramped latch 29, which receives and locks a raised edge on the rear end portion of doors 50*a*, 50*b*. To open doors 50*a*, 50*b*, one merely lifts and opens the door.

Figure 5:
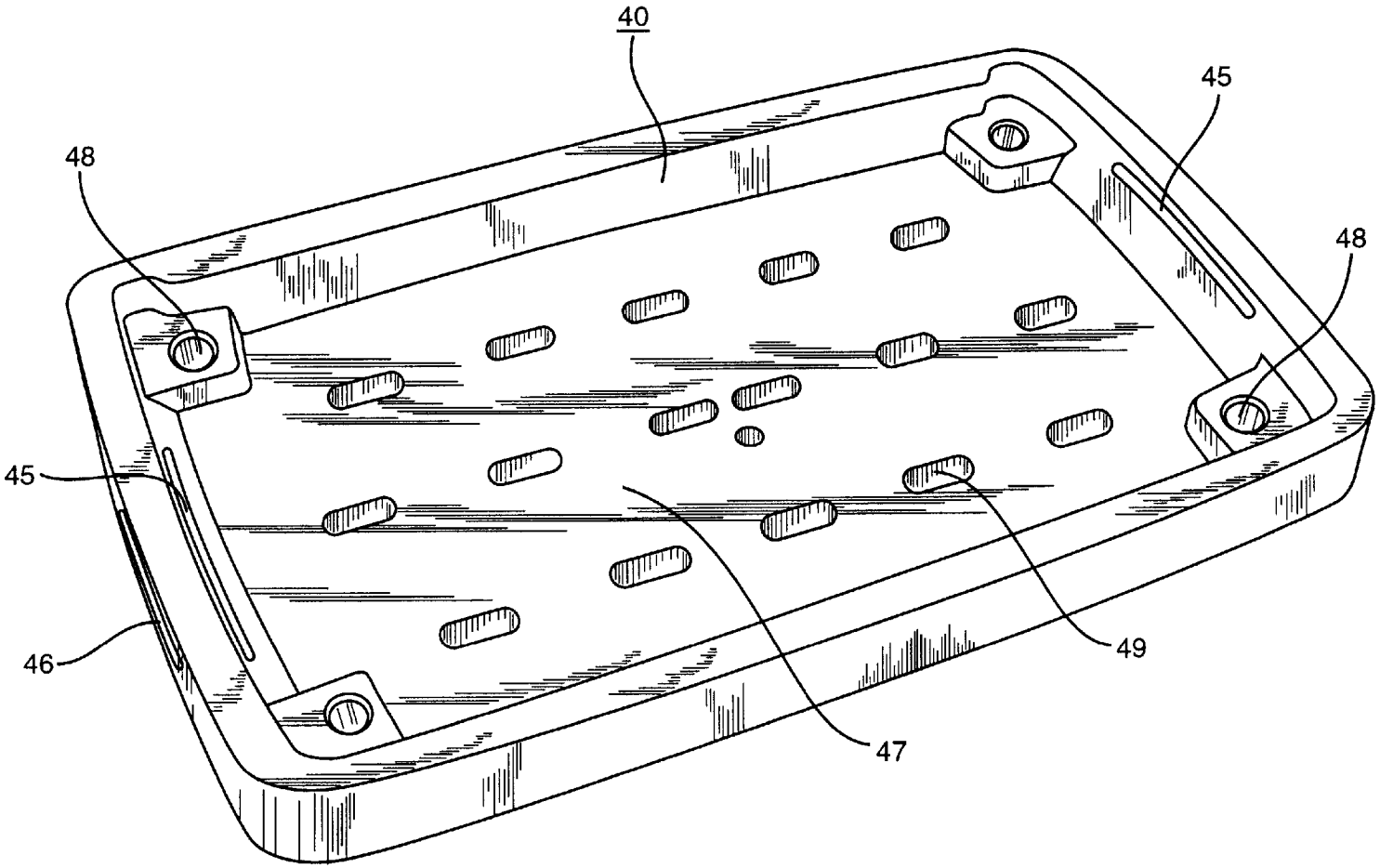
FIG. 5 shows a perspective view of the underside of the lid.
Figure 6:
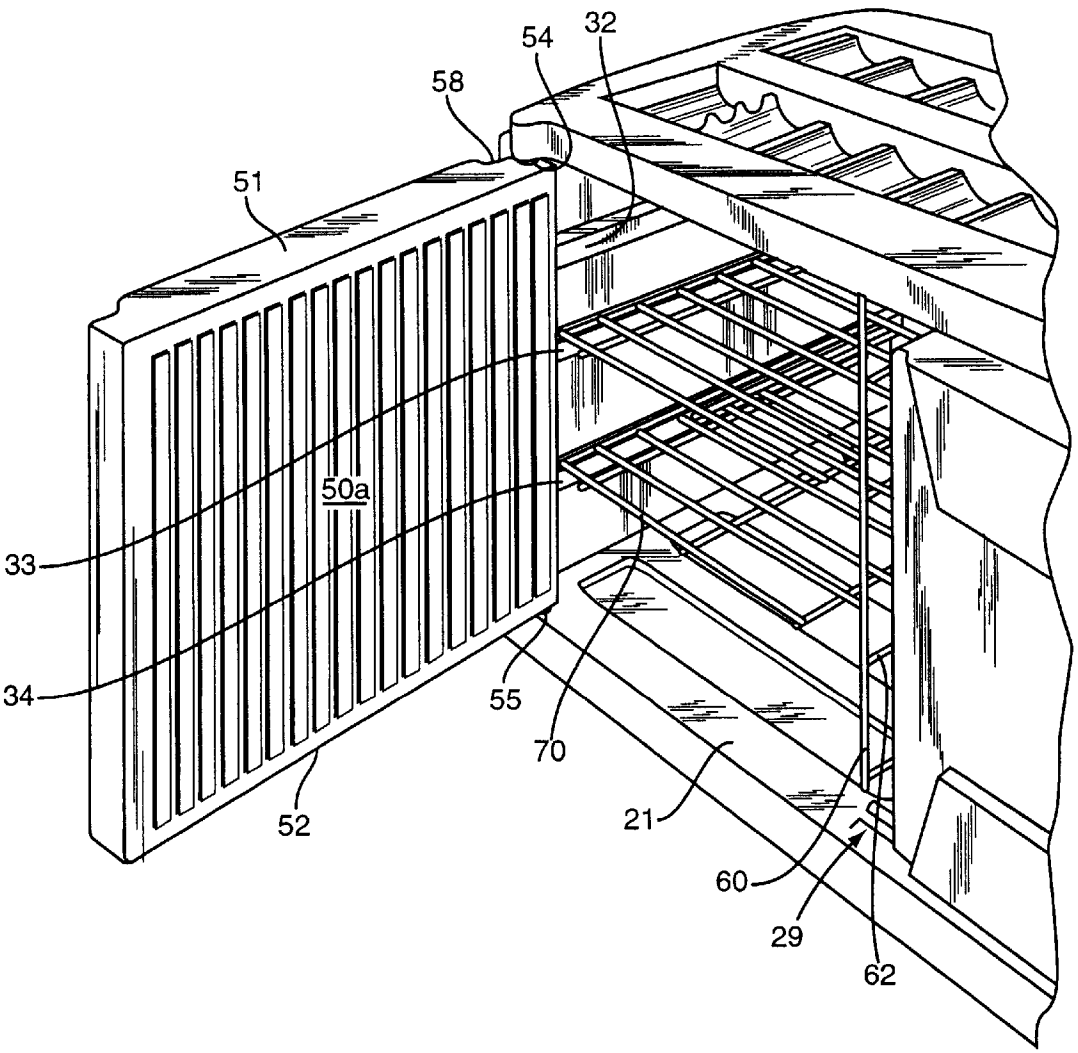
FIG. 6 shows a perspective view of the backside of one of the doors.

FIGS. 1 & 2 show the storage and table unit 10 assembled as a storage container. The lid 40 is removably attached to the top wall 25 of the main body 20 and includes a top surface 41 having a plurality of grooves 42 therein. The lid 40 further includes recessed end portions 43 which include pivot recesses 44 to receive table extensions as will be explained further hereinafter. When attached to the main body 20, the inner surface of end walls 41 of the lid have detents 45 which engage complementary friction projections 47 of the main body to secure the lid 40 thereto. The lid 40 further comprises exterior detents 46 on the ends to enable a person to grip the lid 40 for detachment from the main body 20. FIG. 5 shows a bottom side 47 of the lid 40 which includes ribs 49 that strengthen the lid. Bottom side 47 further includes leg mounting wells 48 in the corners thereof.

Figure 9:
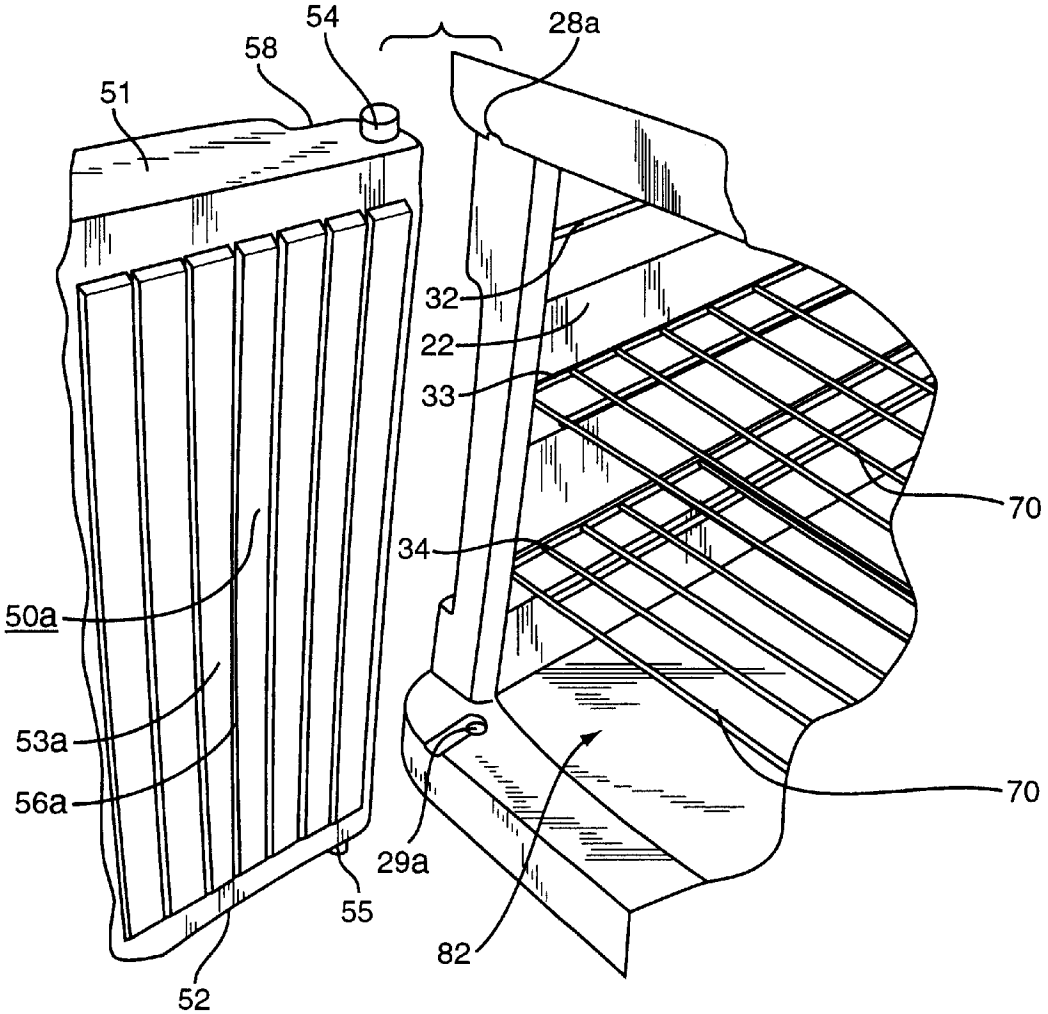
FIG. 9 is a perspective of one of the frame portions of the chest which illustrates the door/chest attachment recesses.
Figure 10:
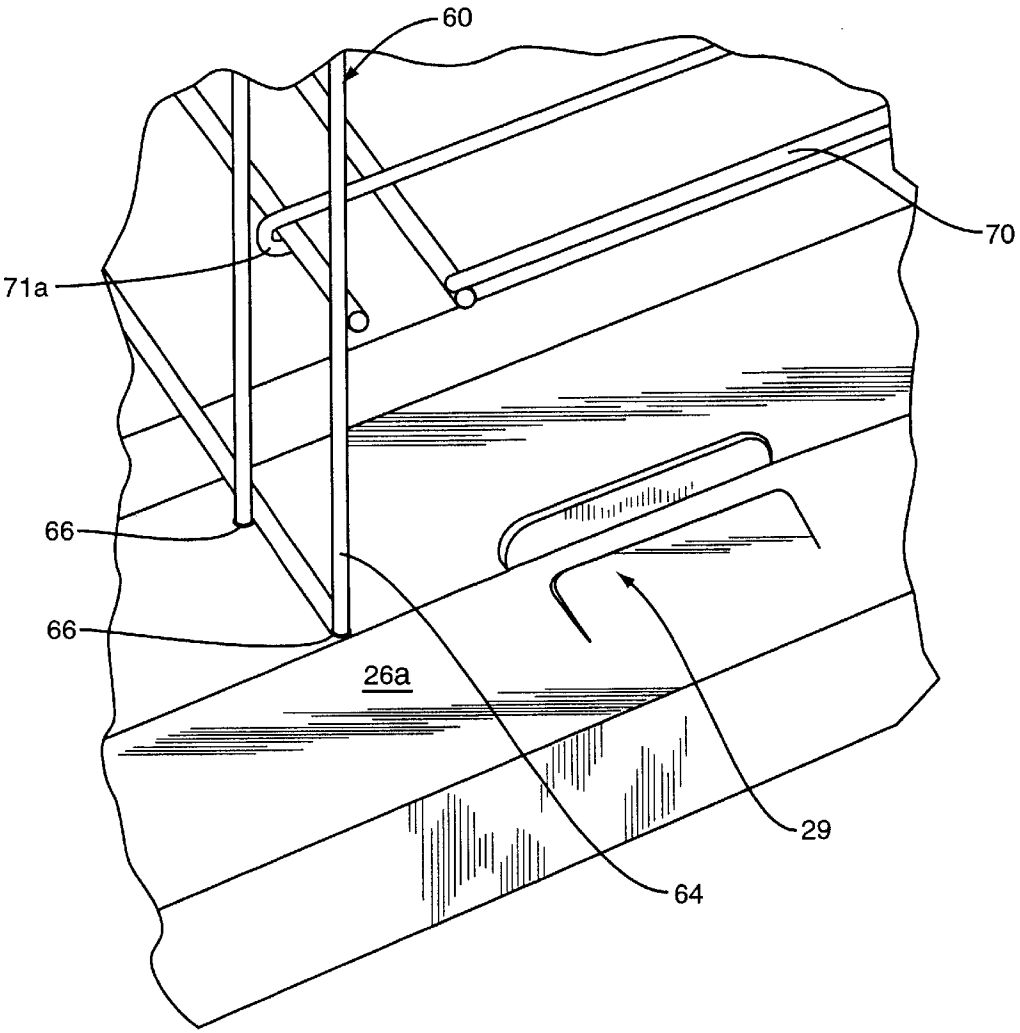
FIG. 10 is a partial perspective view of the central front portion of the bottom wall with the ramped latch.

As shown in FIG. 1, when the storage and table unit 10 is assembled as a storage container, doors 50*a*, 50*b* are attached to the front side 21 of the main body 20 for selectively opening and closing a storage compartment 82 (shown in FIG. 2) within the main body. More specifically, as shown in FIG. 9, the door 50*a* comprises upper and lower pivot posts 54*a* and 55*a* respectively attached to top and bottom sides 51*a* and 52*a*, respectively, of the door 50*a*. The pivot posts 54*a* and 55*a* mount within pivot holes 28*a* and 29*a* of the main body. The door 50*b* similarly comprises upper and lower pivot posts 54*b* and 55*b* attached to top and bottom sides 51*b* and 52*b*, respectively, of the door 50*b*. The pivot posts 54*b* and 55*b* mount within pivot holes 28*a* and 29*a* of the main body. The doors 50*a* and 50*b* have rear surfaces 53*a* and 53*b*, respectively. The rear surfaces 53*a* and 53*b* include a plurality of grooves 56*a* and 56*b* to be compatible as the surface of a table extension. Doors 50*a* and 50*b* further include front surfaces 57*a* and 57*b*, respectively, which optionally may include respective graphic logos 58*a* and 58*b*. It should be noted that doors 50*a* and 50*b* are mirror images of one another. The ends of the doors are recessed (58) to be complementary to the shape of recessed end portions 43 in the lid 40.

As shown in FIG. 2, main body 20 comprises an interior storage compartment 82 for By organizing and storing various items. The ends 23, 24 and rear side 22 of the main body include an upper shelf ledge 32, mid shelf 33 and a lower shelf ledge 34. Ledges 30 and 31 protrude into the storage compartment 82 for holding shelves. Upper shelf ledge 32 forms a hand recess for gripping the main body 20.

The storage and table unit may comprise one or more dividers 60 including a pair of vertically extending posts connected by a plurality of horizontal rungs 62. Posts 64 are received in holes 66 in the bottom and top walls 25, 26. One or more shelves 70 may be mounted between rungs 62 of divider 60 and shelf ledges, 32, 33, and 34. More particularly, a first end 71*a* of a shelf 70 can be mounted to a rung 62 and a second end 72*a* of a shelf 70 may be mounted to a shelf ledge 32, 33, or 34. As an illustration the divider 60 is installed within the storage compartment and oriented such that the rungs 62 extend from the front side 21 of the main body towards the back side 22 of the main body. A shelf 70 extends between a rung 62 and a middle shelf ledge 33. A first end 71*a* of the shelf is mounted to a rung 62 and a second end 71*b* of the shelf is mounted to the middle shelf ledge 33*a*. Thus, the storage compartment 82 is divided into several sub-compartments for organizing various items. However, in other embodiments, shelves 70 could be mounted between rungs 62 and other shelf ledges. Additionally, the divider 60 may be positioned in different locations within the storage compartment 82 and shelves 70 of varying lengths could be used. Furthermore, the divider 60 may be oriented such that the rungs extend from one end 23 or 24 of the main body to the other end 24 or 23 of the main body, and shelves 70 may extend between rungs 62 and shelf ledges 30 and 31 on the rear side of the main body. Thus, the storage compartment may be divided into sub-compartments in many different ways in order to organize and store items as needed.

Figure 3:
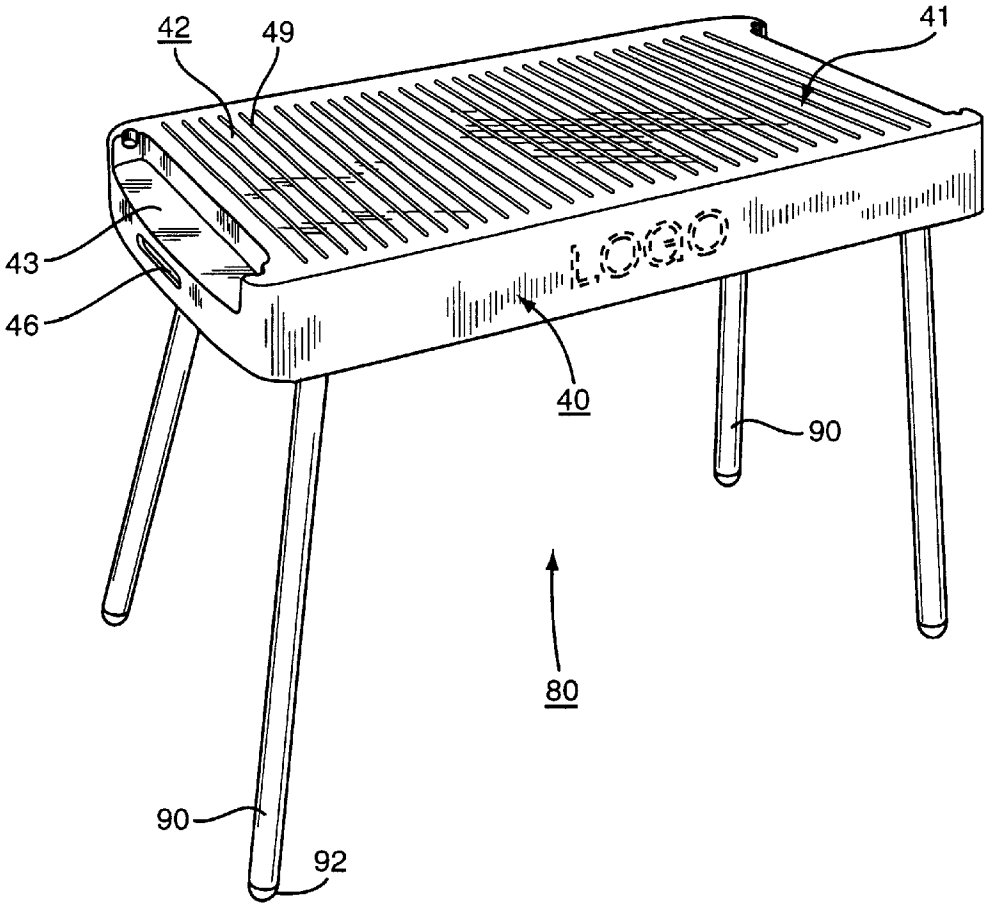
FIG. 3 shows a perspective view of the table without extension.
Figure 4:
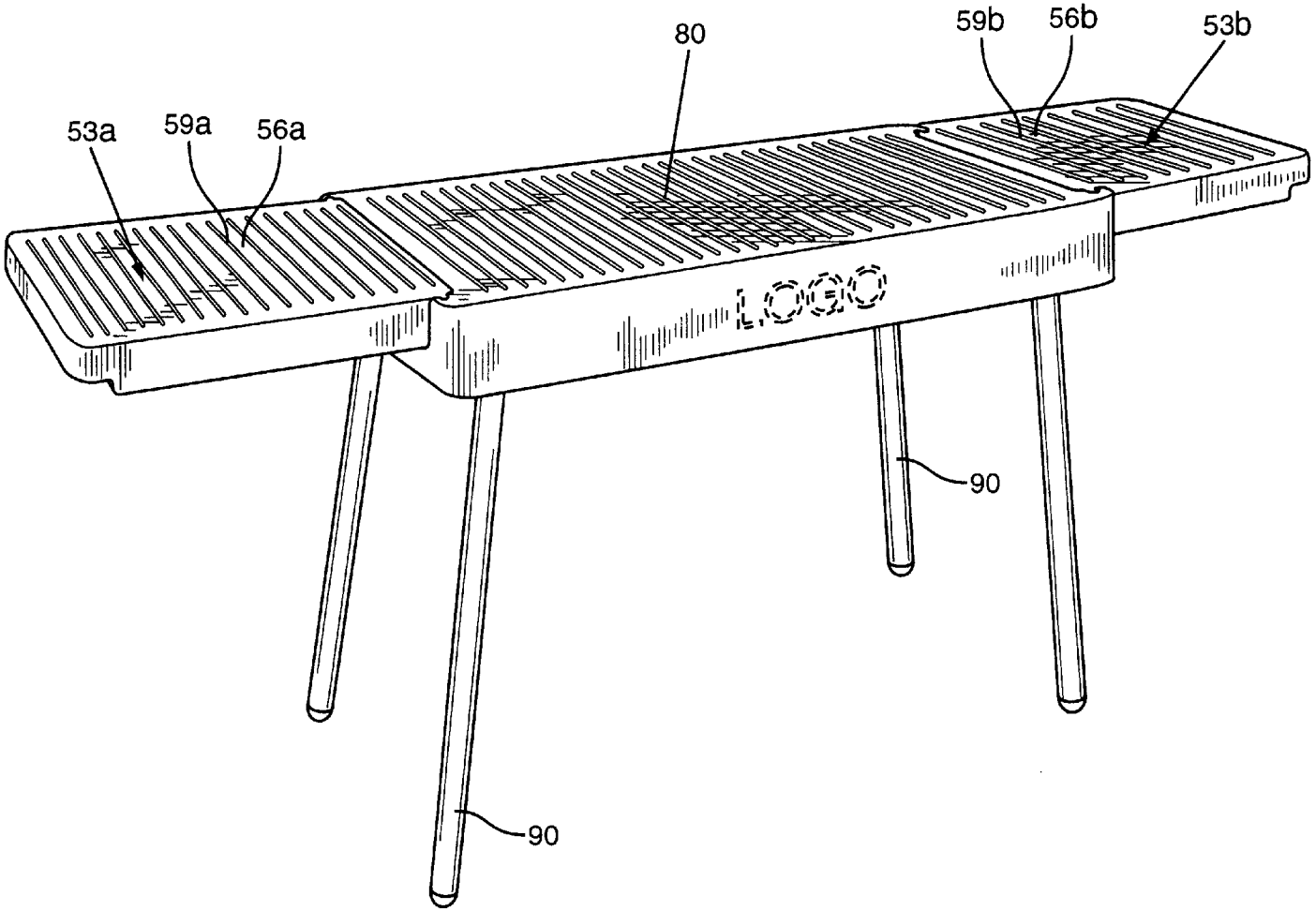
FIG. 4 shows a perspective view of the SUV table unit with extension.

An important feature of the storage and table unit 10 is that it converts from a storage unit, as described in preceding paragraphs, to a table 80 as shown in FIGS. 3 and 4. The components of the table 80 and methods for assembling the table 80 will now be described.

Figure 7:
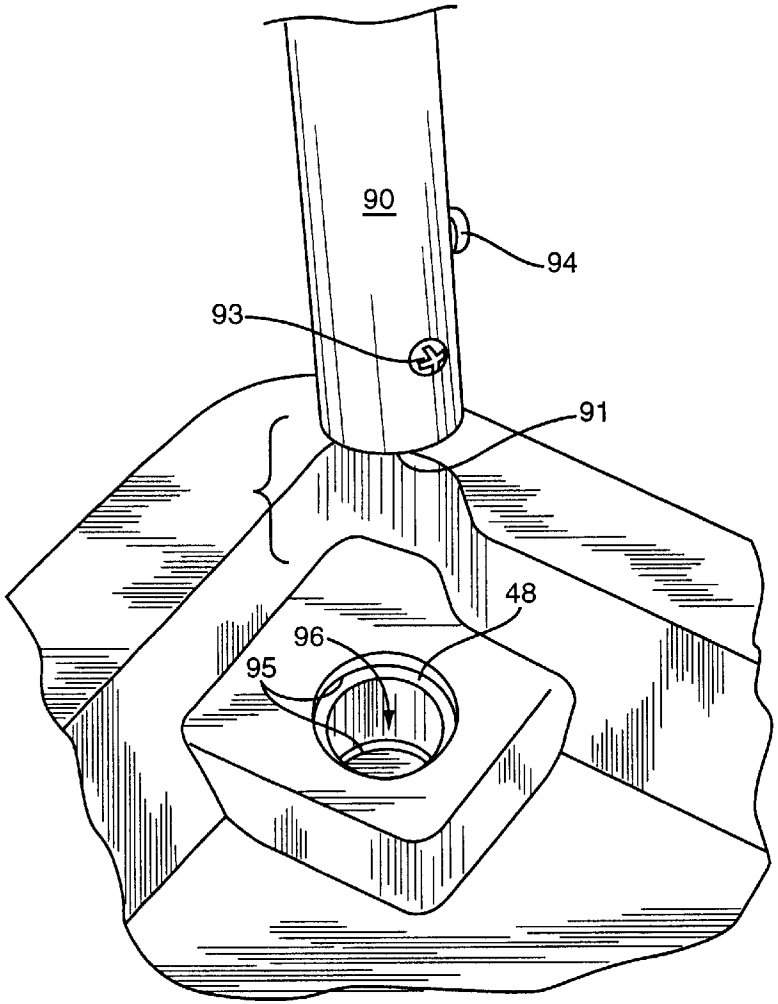
FIG. 7 is an enlarged perspective view of a corner of the underside of the lid illustrating the leg mounting well in the corner thereof.

Referring to FIG. 4, the lid 40 detaches from the main body 20 to form a table top. The storage and table unit 10 includes four legs 90 normally stored within the area occupied by the beverage can wells. The table legs 90 comprise an upper end 91 which connects to the underside of lid 40 and a lower end 92 for resting on a support surface (not shown). More specifically, the upper end 91 of each table leg attaches to a respective leg mounting well 48 to form the table 80. FIG. 7 illustrates a leg receiving well which receives the upper end 91. Each leg 90 includes a pair of arcuately and linearly spaced projections 93 and 94. The leg receiving well 48*a* includes a spiral groove 95 extending from an entrance 96 down the inner wall. One of the projections 93 is placed in the groove 95, and the leg is rotated approximately 90° until the second projection 94 seats in the entrance. This insures that all four legs 90 are inserted the same distance into the spiral groove, and that the table will be level. It should be understood that the remaining legs 90 attach to the other leg receiving wells 48, in similar fashion. The top surface 41 of the lid 40 forms the top surface of the table top. The grooves 42 of the lid channel crumbs and moisture into channels 49 thus helping to keep the surface of the table top clean and dry.

Figure 8:
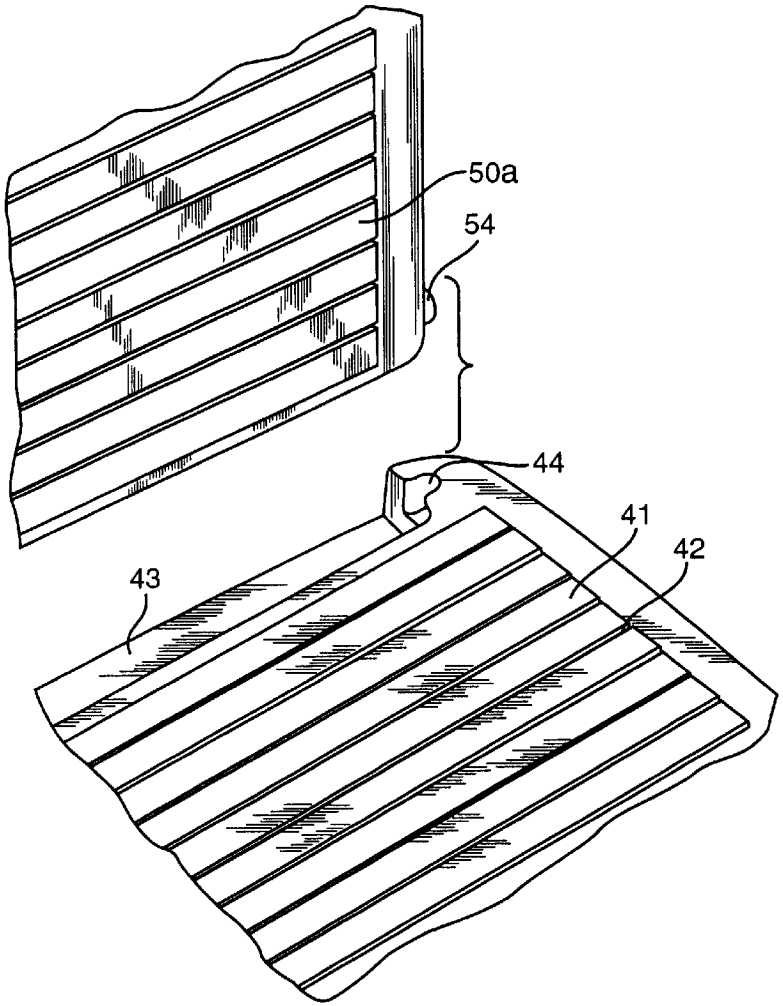
FIG. 8 is a perspective of the end portion of the lid illustrating the extension/table attachment recess.

Optionally, doors 50*a* and 50*b* detach from the main body 20 and attach to the lid 40 to form table top extensions. FIG. 2 shows the doors 50*a* and 50*b* detached from the main body 20. As illustrated in FIG. 9, pivot posts 54*a* and 55*a* detach from pivot holes 28*a* and 29*a* of door 50*a*, and pivot posts 54*b* and 55*b* detach from pivot holes 28*b* and 29*b* of door 50*b*. Once the doors 50*a* and 50*b* have been detached from the main body 20, they can be attached to the lid 40 (FIG. 8). The door 50*a* aligns within the recessed end portion 43 of the lid 40, and the pivot posts 54*a* and 55*a* insert within the pivot recesses 45*a* and 44*a*, respectively, to form a first table extension. Similarly, the door 50*b* aligns within the recessed end portion 43 of the lid 40, and the pivot posts 54*b* and 55*b* insert within the pivot recesses 45*b* and 44*b*, respectively, to form a second table extension. The doors 50*a* and 50*b* are oriented such that their rear surfaces 53*a* and 53*b* form top surfaces of the table extensions. The slats formed between grooves 56*a* and 56*b* of rear surfaces 53*a* and 53*b* support food and beverages and the grooves tend to channel crumbs and moisture into channels 59*a* and 59*b* between the respective slats 56*a* and 56*b*.

It will be understood by those skilled in the art that while the foregoing invention has a been disclosed with reference to preferred embodiments or features, various modifications, changes and additions can be made to the foregoing invention without departing from the spirit and scope of the invention as set forth in the following claims.

What is claimed is:

1. A convertible storage/table product comprising:

a) a main chest body including a storage compartment and having front, rear, sidewalls, a top, and a bottom;

b) a lid removably attachable to the chest body, wherein the lid comprises a top surface including a plurality of raised slats having grooves formed therebetween, the raised slats and grooves so dimensioned to form a table top;

c) doors releasably attached to the front of the main chest body to selectively open and close the storage compartment and are also releasably attached to the lid to form table top extensions, the doors having rear surfaces; and d) a plurality of leg members, normally carried by one of the chest and lid, and selectively attachable to the lid to form a table.

2. The convertible storage/table product of claim 1, wherein the lid comprises a bottom side having a plurality of leg mounting wells, and wherein the upper end of each leg member is received in one of the leg mounting wells.

3. The convertible storage/table product of claim 1, wherein:

the doors include pivot posts for releasably attaching the doors to corresponding pivot holes in the main body;

the lid includes end portions having recesses therein; and the doors align within the recessed end portions and the pivot posts are received in the recesses to attach the doors to the lid, thus forming the table top extensions.

4. The convertible storage/table product of claim 1, wherein the rear surface of the doors comprise a plurality of raised slats and, when assembled to the lid, form top surfaces of the table top extensions similar to the top surfaces of the lid.

5. The convertible storage/table product of claim 1, further comprising a vertical divider inserted within the storage compartment between the top and bottom thereof, and at least one shelf mounted between the divider and one sidewall to divide the storage compartment into a plurality of sub-compartments.

6. The storage compartment of claim 5, wherein one end of the shelf is mounted to the divider and a second end of the shelf rests on a shelf ledge in an interior surface of one of the sidewalls in the main chest body.

7. A convertible storage/table product comprising:

a) a main chest body including a storage compartment and having front, rear, sidewalls, a top, and a bottom;

b) a lid removably attachable to the chest body;

c) doors that are releasably attached to the front of the main chest body to selectively open and close the storage compartment and are also releasably attached to the lid to form table top extensions, the doors having rear surfaces; and d) a plurality of leg members, normally carried by one of the chest and lid, and selectively attachable to the lid to form a table.

8. The convertible storage/table product of claim 7, wherein the lid comprises a top surface including a plurality of raised slats having grooves formed therebetween, the raised slats and grooves so dimensioned to form a table top.

9. The convertible storage/table product of claim 7, wherein the lid comprises a bottom side having a plurality of leg mounting wells, and wherein the upper end of each leg member is received in one of the leg mounting wells.

10. The convertible storage/table product of claim 7, wherein:

the doors include pivot posts for releasably attaching the doors to corresponding pivot holes in the main body;

the lid includes end portions having recesses therein; and the doors align within the recessed end portions and the pivot posts are received in the recesses to attach the doors to the lid, thus forming the table top extensions.

11. The convertible storage/table product of claim 7, wherein the rear surface of the doors comprise a plurality of raised slats and, when assembled to the lid, form top surfaces of the table top extensions similar to the top surfaces of the lid.

12. The convertible storage/table product of claim 7, further comprising a vertical divider inserted within the storage compartment between the top and bottom thereof, and at least one shelf mounted between the divider and one sidewall to divide the storage compartment into a plurality of sub-compartments.

13. The storage compartment of claim 12, wherein one end of the shelf is mounted to the divider and a second end of the shelf rests on a shelf ledge in an interior surface of one of the sidewalls in the main chest body.

* * * * *